US010023382B2

(12) United States Patent
Hess

(10) Patent No.: US 10,023,382 B2
(45) Date of Patent: Jul. 17, 2018

(54) UNIVERSAL LOCK FOR THE HOOK OF A ROLL-OFF CONTAINER AND METHOD OF USE

(71) Applicant: Ryan J. Hess, Washington, PA (US)

(72) Inventor: Ryan J. Hess, Washington, PA (US)

( * ) Notice: Subject to any disclaimer, the term of this patent is extended or adjusted under 35 U.S.C. 154(b) by 317 days.

(21) Appl. No.: 15/145,944

(22) Filed: May 4, 2016

(65) Prior Publication Data

US 2016/0333612 A1 Nov. 17, 2016

Related U.S. Application Data

(60) Provisional application No. 62/157,872, filed on May 6, 2015.

(51) Int. Cl.

| | |
|---|---|
| ***B65D 90/22*** | (2006.01) |
| ***E05B 73/00*** | (2006.01) |
| ***E05B 83/02*** | (2014.01) |
| *E05B 67/38* | (2006.01) |
| *B65D 90/00* | (2006.01) |

(52) U.S. Cl.

CPC ..... *B65D 90/22* (2013.01); *E05B 73/00* (2013.01); *E05B 83/02* (2013.01); *B65D 90/0033* (2013.01); *B65D 2211/00* (2013.01); *E05B 67/383* (2013.01)

(58) Field of Classification Search

CPC ... Y10T 70/5031; E05B 83/02; E05B 67/383; E05B 73/00; E05B 73/0023; B65D 90/22; B65D 90/003; B65D 2211/00

USPC .... 70/14, 18, 19, 57, 58, 63, 200, 203, 209, 70/212, 232, 258; 280/507, 510; 410/80

See application file for complete search history.

(56) References Cited

U.S. PATENT DOCUMENTS

| | | | | |
|---|---|---|---|---|
| 2,169,860 A * | 8/1939 | Von Hoorn | H01H 9/282 | 200/322 |
| 3,291,924 A * | 12/1966 | Tharp | H01H 9/283 | 200/43.15 |
| 4,260,861 A * | 4/1981 | DiMarco | H01H 9/282 | 200/43.15 |
| 4,836,570 A * | 6/1989 | Lopez | B60D 1/60 | 280/507 |
| 4,996,855 A * | 3/1991 | Havenga | B60D 1/60 | 70/14 |
| 5,782,115 A * | 7/1998 | Judy | B60D 1/60 | 248/552 |
| 5,794,961 A * | 8/1998 | Niswanger | B60D 1/065 | 280/507 |

(Continued)

FOREIGN PATENT DOCUMENTS

DE 102005013691 A1 * 9/2006 ..... B65D 88/12

*Primary Examiner* — Suzanne L Barrett
(74) *Attorney, Agent, or Firm* — Gary P. Topolosky

(57) ABSTRACT

A lock for the hook of a roll-off container box comprises a rail member with two substantially parallel brackets, each bracket having a plurality of apertures for receiving at least one padlock, said brackets terminating at one end in a carrying handle and at the opposite end with a connector pin for engaging with the container box hook. The lock further comprises a box-like outer cover for the rail member, that outer cover having a front wall, a rear wall, a top surface and spaced apart sidewalls. Each sidewall has a track that commences at its bottom edge, and extends parallel to that bottom edge before branching off into an upper and lower pathway for the rail member's connector pin to slide along.

19 Claims, 9 Drawing Sheets

(56) References Cited

U.S. PATENT DOCUMENTS

| | | | | |
|---|---|---|---|---|
| 5,983,684 | A * | 11/1999 | Boisvert | B60R 25/00 70/14 |
| 7,262,376 | B2 * | 8/2007 | Brojanac | H01H 9/283 200/43.14 |
| 7,425,016 | B2 * | 9/2008 | Bowsher | B60D 1/065 280/500 |
| 8,888,422 | B2 * | 11/2014 | Miller | E05B 73/00 410/80 |
| 8,966,945 | B1 * | 3/2015 | Buechel | E05B 73/0023 70/14 |
| 2007/0108732 | A1 * | 5/2007 | Silva, II | B60D 1/60 280/507 |

* cited by examiner

UNIVERSAL LOCK FOR THE HOOK OF A ROLL-OFF CONTAINER AND METHOD OF USE

CROSS-REFERENCE TO RELATED APPLICATION

This is a perfection of Provisional Application Ser. No. 62/157,872, filed on May 6, 2015, the disclosure of which is fully incorporated by reference herein.

BACKGROUND OF THE INVENTION

Field of the Invention

This invention relates to security systems, more specifically, locks for the hooks of roll-off storage containers to prevent their unauthorized transport.

Roll-off containers are large wheeled bins, usually made of steel, which may be covered or left open. These containers are used to store and transport a variety of materials including trash, scrap metal and, in some cases, finished product. In operation, a roll-off container is delivered to a worksite on a tilt bed truck. That container is unloaded at a given worksite by tilting the truck bed and allowing the wheeled container to roll off. When finished (or full), this container gets removed from the worksite by cabling to the loading hook on one end of the container and winching it back onto a truck bed. Unfortunately, the relative ease of moving such containers makes them vulnerable to theft via unauthorized loading and transport.

Problem: Roll-off Container security is a growing problem in scrap operations, chemical plants, oil & gas operations, contaminated soil projects, and equipment storage yards. Containers are picked up by unknowing operators and removed from sites never to be seen again. This sends the company who owns the equipment into a frenzy trying to locate the box and reclaim its investment and deal with any fallout from the products located within.

Solution: Steal Stinger™ can lock the equipment out from trucking companies and unwanted theft by no longer allowing the box to be easily picked up and hauled away by truck. The design of this invention allows all style and size of container hooks to be accommodated due to its side-locking guide rails and dual arm offset clasp holes in the rear.

Relevant Art—Several methods are known for providing roll-off containers with locking devices. However, prior art systems were mechanically complex making them difficult to use and restricting their utility to particular roll-off container designs. One such locking system attempt is shown in Miller U.S. Published Application No. 20130269400.

Current alternatives, summary:

Box Lox—sells for $289 with a lock but does not fit all hook styles due to its flat back design, single arm operation, and the absence of guide rails for different manufacturers. Its overall body is built of thinner metal and is more susceptible to tampering due to its steel thickness. Also the build quality of each Box Lox is noticeably less than the Steal Stinger from a side-by-side comparison of welds and ingenuity.

Roc-Loc—sells for $420 without a lock, includes one draw bar and must be custom-ordered to fit each hook style from different manufacturers. If one orders a unit with two draw bars, the price goes to $590 without locks but its operation forces the user to lock said device in an awkward manner, prohibiting its use on shallow container styles. Worse, it still allows for security-vulnerable gaps between the lock device and container proper.

The above two products are the only existing competition in the market today. Neither provides a truly universal fit, easy operation, and security demanded of a container locking system like the present invention.

The present invention, known as a Steal Stinger™, differs from the Miller device in several key ways. While similar in external appearance by having an outer box, the Miller system (or BoxLox) uses only one locking bar that when just angled upwardly limits its use with many container box hooks. Furthermore, that locking bar has few inadequately spaced holes in which to insert a padlock.

The object of this invention uses a drawbar with TWO member rails spaced apart and separated substantially parallel to one another with a hook-engaging welded pin between the two member rails at one end and a preferred integral carrying handle at the opposite end. When that drawbar is positioned in a box hook beneath the cover component of this device, it can be pulled towards the installer (while still beneath that cover component) into one of two welded pin tracks: (a) a first horizontal track substantially parallel with the bottom surface of the cover component for some box hook applications; OR (b) a slightly upwardly angled track at the far end for most other box hook applications where the first track either does not suffice or is less "convenient". With the foregoing "dual track" system, this invention accommodates numerous more box hook styles and ceiling heights.

The present invention also differs from the systems made and sold under the Roc-Locks brand. The latter consists of TWO potentially custom-made brackets that slide forward into a common front hook latch fitted into the container box hook before being awkwardly locked in place at the front end of those brackets in a hard-to-access area for a difficult installation and even tougher removal when no longer needed. The single Roc-Locks unit is also inherently precluded from use on multiple box styles. No one Roc-Lock length/design can account for various hook heights and diameter tolerances. Furthermore, the aforementioned configuration still allows for straps and/or chains to be accessed beneath (or about) its dual brackets that have no over-cover thus subverting the security aspects of said device.

Another security lock system for a roll-off container (or skid) is shown in Havenga et al U.S. Pat. No. 4,996,855. It is far from universal, however. Finally, there is a locking system for automotive applications worth noting. Cardin Sr. U.S. Pat. No. 3,782,761 shows a locking box cover for the outermost end of a vehicular trailer hitch.

As will be explained below, this invention provides a much more universal lock over most every size and shape of hook for roll-off storage containers. Several representative style/sizes of hook configurations are shown in accompanying FIGS. 1A through 1F. Note how they differ in size (width and/or height) and shape of the forward opening hook as well as the relative location of that hook to: the adjacent container floor in said hook area, nearby container sidewalls and sloping base walls of the respective examples shown. The first, FIG. 1A, is from a Sabre Vacuum Box. FIG. 1B is the hook from a Domatex container box. FIG. 1C is from a Bucks Vacuum box. FIG. 1D is from a Thompson Fabricating roll off container. FIG. 1E is from Wasteequip and FIG. 1F from a Northeast Manufacturing box. The device/locking system of this invention will work with any of the foregoing container hook arrangements and also many others. It has a minimal number of parts, is rugged, simple to use, yet provides a high degree of security.

SUMMARY OF THE INVENTION

One preferred embodiment of this invention consists of a two-rail lower bracket member with each rail having a plurality of spaced side holes through which a padlock may be inserted and engaged. At one end of these substantially parallel rail bracket members, there is an integral carrying handle. At the opposite end, there is a welded cross pin for inserting into the hook of a box container.

The aforementioned cross pin fits under a rail bracket outer cover that is substantially rectangular, mostly box-like with a front face, rear wall and pair of opposed sidewalls. That front face includes a pair of spaced apart slots, sized to accommodate the rail bracket members when the latter is fitted into and about a container box hook and the outer cover installed thereover (as described below). The outer cover further includes a top surface but no corresponding bottom wall. Into both sidewalls, there is provided a pair of tracks that commence at a point closer to the outer cover's rear wall. That track commencement extends all the way to the lowermost edge of each sidewall. Both tracks then advance towards the front face of the outer cover, substantially parallel with the lowermost edge to each sidewall to form a pre-cut channel into and through which the cross pin of the rail bracket member is first installed and then pulled forward.

At about the midway point of each sidewall, the correspondingly sized and shaped tracks into the outer cover's spaced sidewalls form a branch off (or Y-shape) with a first branch continuing forward, still substantially parallel with the lowermost edge of the sidewalls. A second branch, however, angles upwardly from the midway point, towards both the front face and top surface of the outer cover so that when the main cross pin gets inserted into this pair of tracks, it can be pulled forward along the first branch in most instances, but alternately into this optional, angled second track in those few instances where a given container box's hook configuration (both size, shape and adjacent hook recess surfaces) necessitate the upward pull of the rail bracket member for more convenient locking (and eventual unlocking). Hence, the more universal installation of this invention for a greater number of container box hook sizes, shapes and surrounds.

To use the aforementioned device for securing the hook of a box container, the installer would first locate the hook pin of the two rail brackets inside the box hook (beneath its outer cover) before pulling the two rail brackets forward to the end of either the cover's lower, horizontally-extending channel, OR its branched off, angled upper channel. Thereafter, the outer cover is secured by inserting at least one, possibly a pair of padlocks, into and through the holes of the rail bracket closest to the outer cover for locking the same in place as best seen in accompanying FIG. 10.

BRIEF DESCRIPTION OF THE DRAWINGS

Further features and advantages of the present invention will become better understood with reference to the following detailed description taken in conjunction with the accompanying drawings in which:

FIG. 1A is a right upper view of the hook area for a Sabre Vacuum box container;

FIG. 1B is a left upper view of the hook area for a Domatex box container;

FIG. 1C is a left upper view of the hook area for a Bucks Vacuum box container;

FIG. 1D is a left upper view of the hook area for a Thompson Fabricating box container;

FIG. 1E is a left upper view of the hook area for a Wasteequip box container; and FIG. 1F a left upper view of the hook area for Northeast Manufacturing box;

DESCRIPTION OF PREFERRED EMBODIMENTS

Figure 1A:
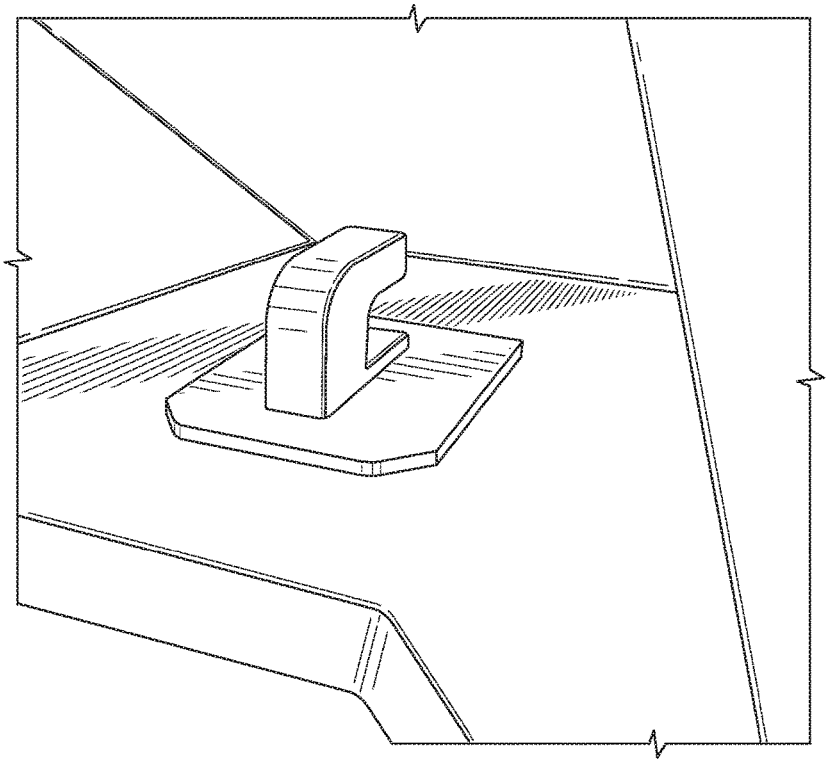
FIGS. 1A through 1F show perspective view of six representative container hook configurations to underscore the structural differences (i.e., size, shape and relative location) known to exist. Particularly.
Figure 1B:
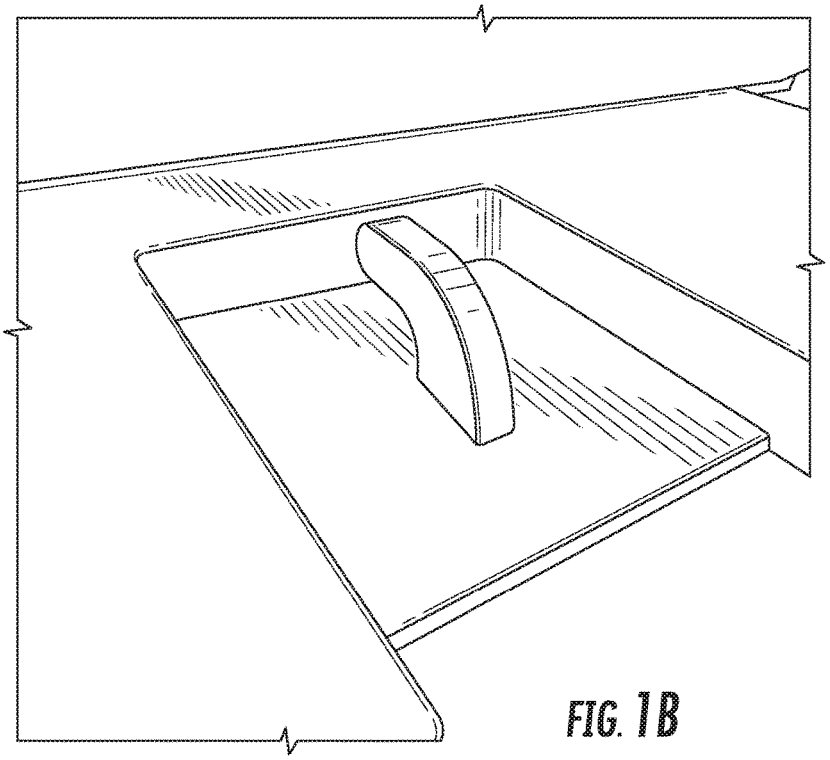
Figure 1C:
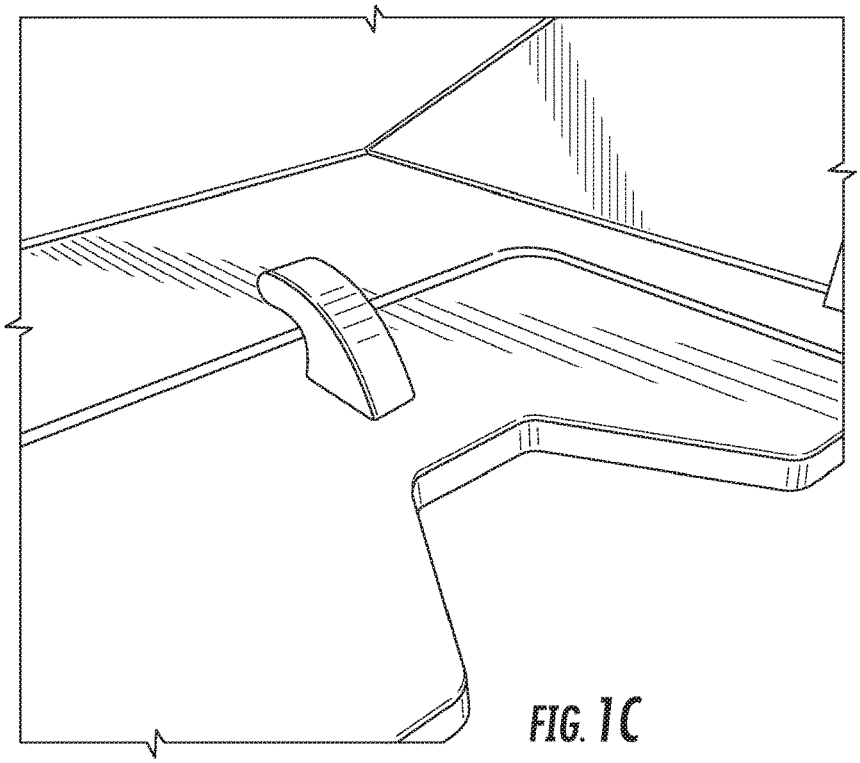
Figure 1D:
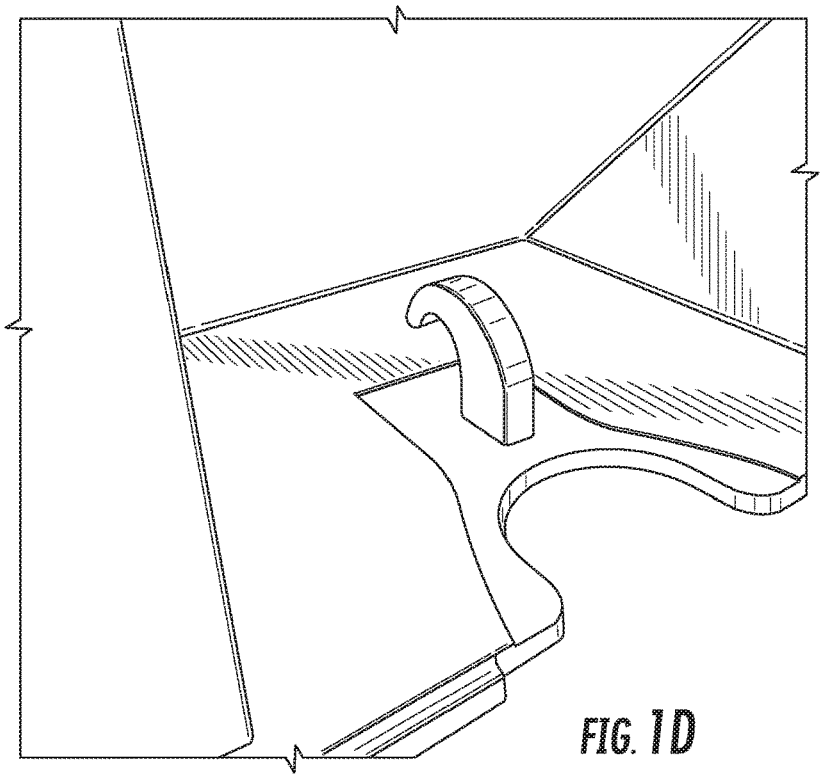
Figure 1E:
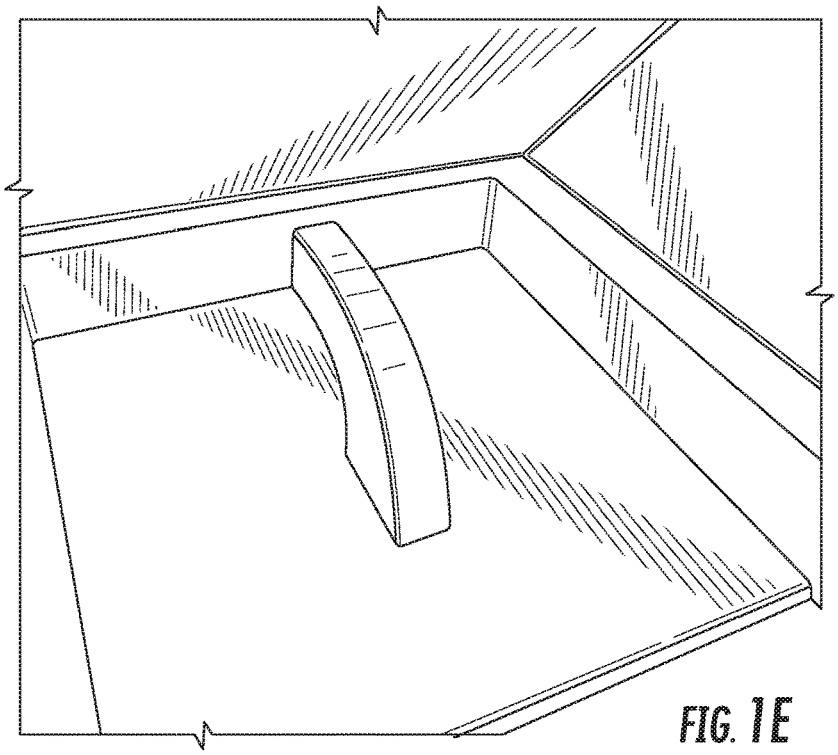
Figure 1F:
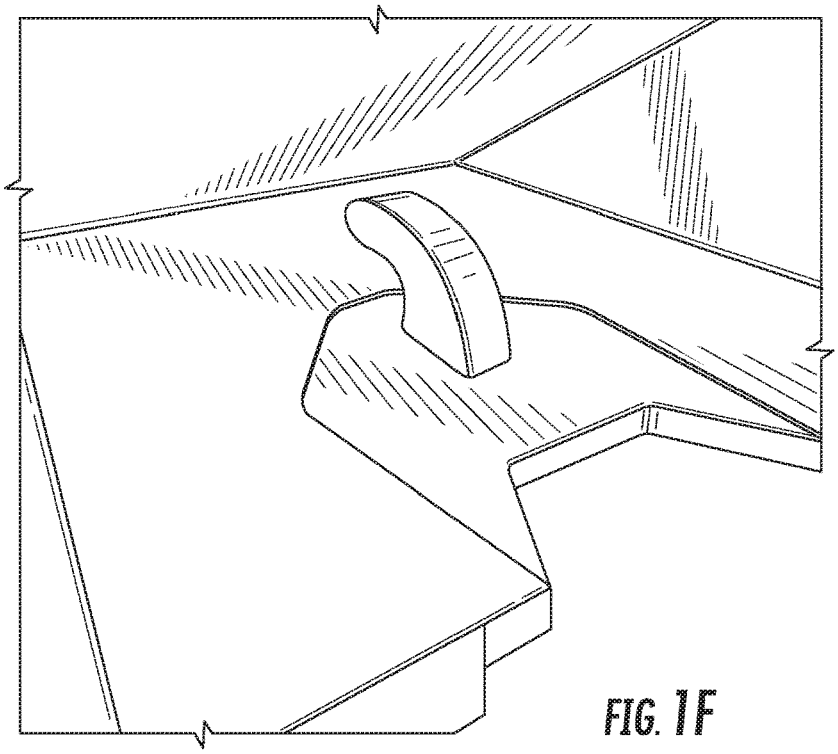
Figure 2:
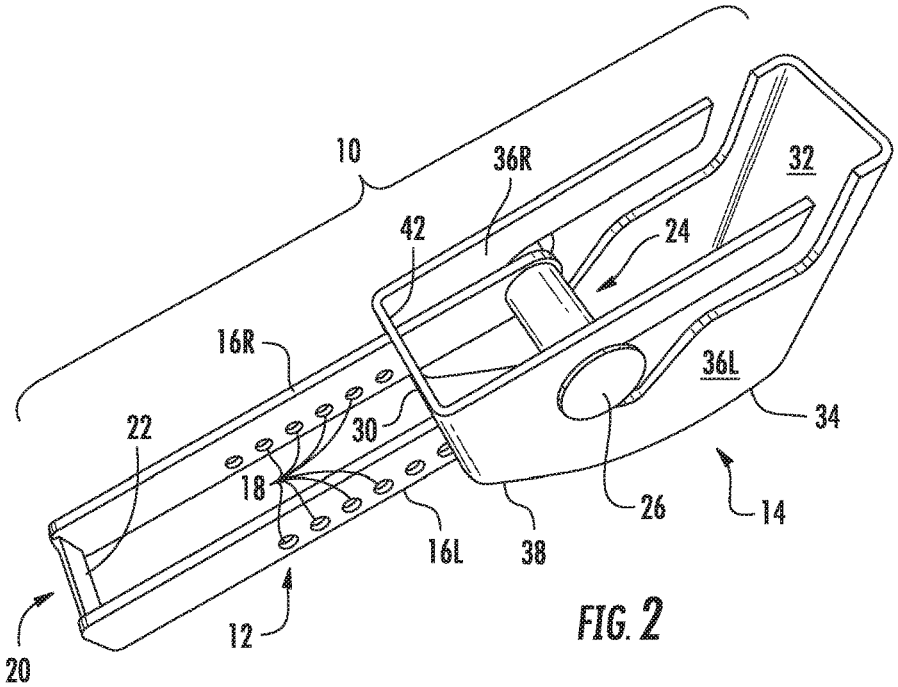
FIG. 2 shows an upper perspective view of the underside to a first embodiment of the present invention.

Representative container box hook shapes, sizes and relative locations are pictured in accompanying FIGS. 1A through 1F. A first preferred embodiment of device per this invention, with a more beveled rear wall to its outer cover, is then shown in accompanying FIGS. 2 through 6. A second embodiment, with a flatter, less angled rear wall outer cover, is shown in accompanying FIGS. 7 through 10. Both configurations are meant to secure various styles of hooks and box builds from different roll off container manufacturers across the country.

In the accompanying detailed description, component elements common to both the first and second embodiments are commonly numbered though in the next hundred series. For the first embodiment, therefore, device 10 consists of a rail member component 12 and outer cover component 14. The rail member 12 consists of a pair of spaced apart (preferably parallel) lower brackets 16L and 16R, each of said lower brackets having a plurality of spaced holes/apertures 18 there along. Such holes are sized to accommodate a padlock (not shown) at various locking points of the device 10 when installed over and about the hook of a container box.

At one end (i.e., the forward end 20) of lower brackets 16L and R of rail member 12, there is shown a pull handle 22 that can also serve as a carrying handle for transporting device 10 to a container box site for installation about its front hook. Preferably, pull handle is integrally formed from the same material as, and commonly sized like, lower bracket 16L and lower bracket 16R.

At an opposite end to forward end 20, or rearward end 24, both lower bracket components 16L and R are joined together with a 1⅞" diameter metal pin 26, preferably welded a spaced distance apart from both lengthwise components to rail member 12. Together, these two main brackets 16L and R, and connecting metal pin 26 are designed as one unit for positioning into the hook of most any box container regardless of individual manufacturer's hook height, shape and position relative to the rest of the box end proper. Accordingly, this invention provides security to a much more universal fit of various container box hooks.

The other main component to device 10 is its outer cover 14. That cover is substantially box-shaped with a front wall 30, rear wall 32, top surface 34 and pair of spaced apart sidewalls 36L and R. For aesthetic reasons, front wall 30 may angle upwardly in a beveled section 38 before transitioning into top surface 34. And, as shown, rear wall 32 is angled slightly inwardly towards top surface 34 rather than being sharply right-angled to the same (as is more the case for the second version of device shown in FIGS. 6 through 10). The latter angling is for providing device 10 with a more racy, sleeked back appearance.

Figure 3:
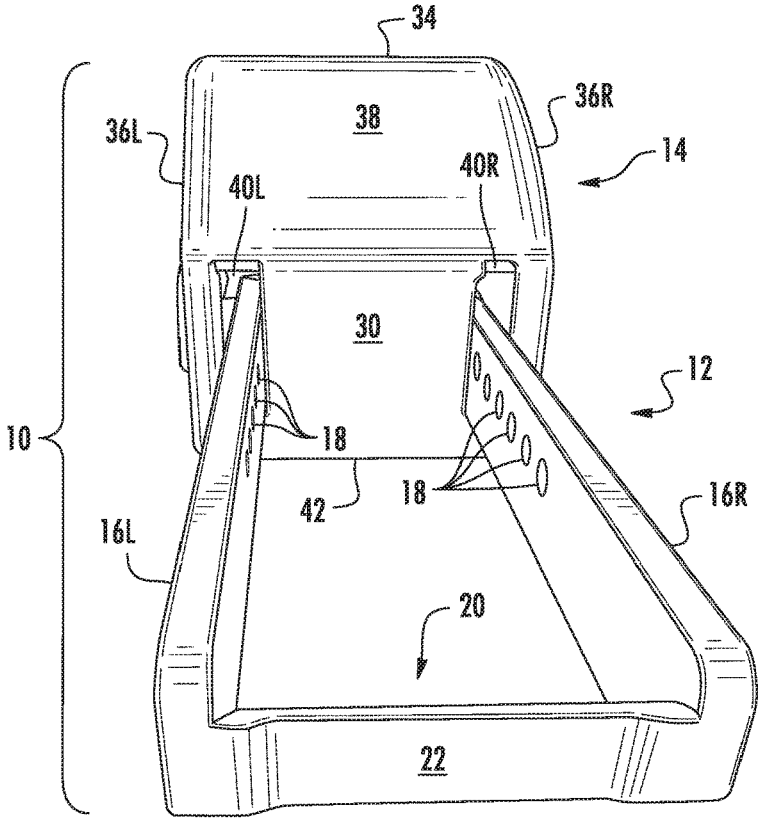
FIG. 3 shows a front, axial view of the embodiment of FIG. 2 uprighted and ready for installation on a container box hook (not shown)
Figure 3A:
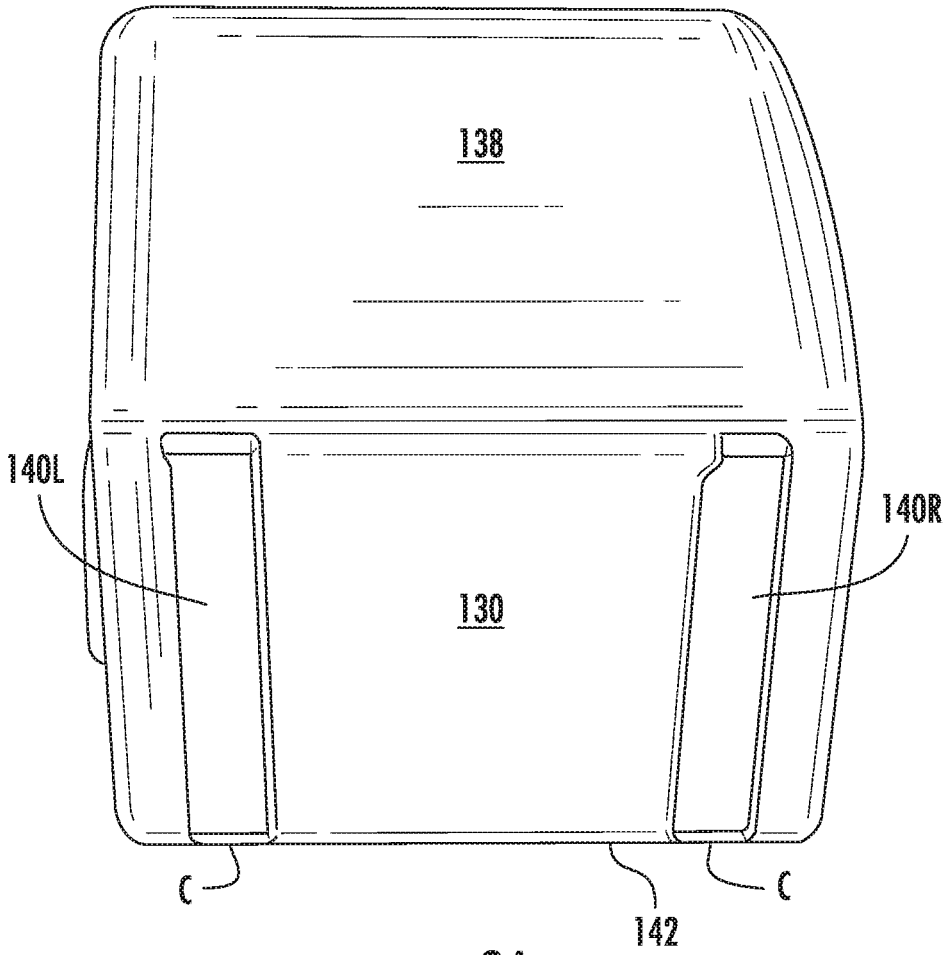
FIG. 3A shows a front, axial view of a first alternative outer cover having slits that extend completely down to the lowermost edge of its front wall before being clipped or slid over once a rail member has been inserted in said modified slits.
Figure 4:
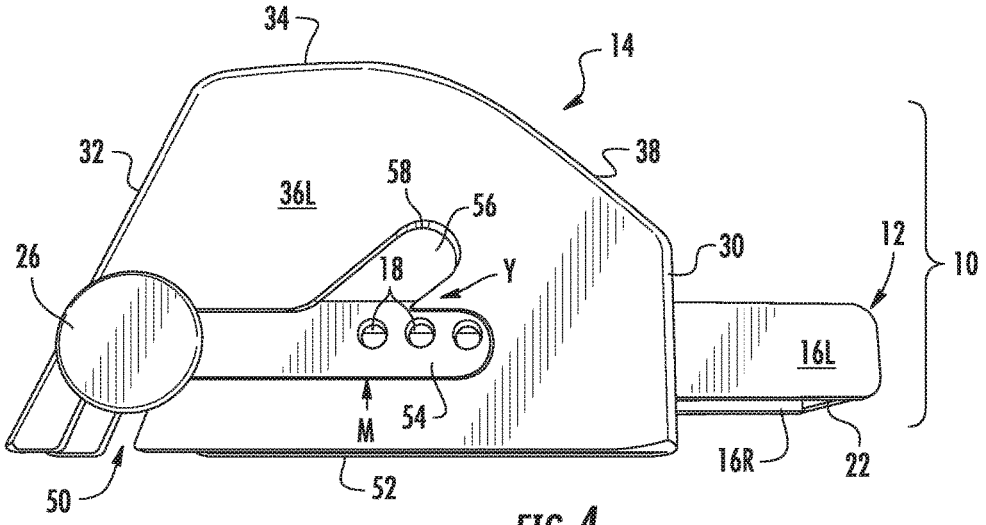
FIG. 4 shows a left side view of the embodiment from FIGS. 2 and 3 with its lower pin component having first entered the cover slide paths.
Figure 5:
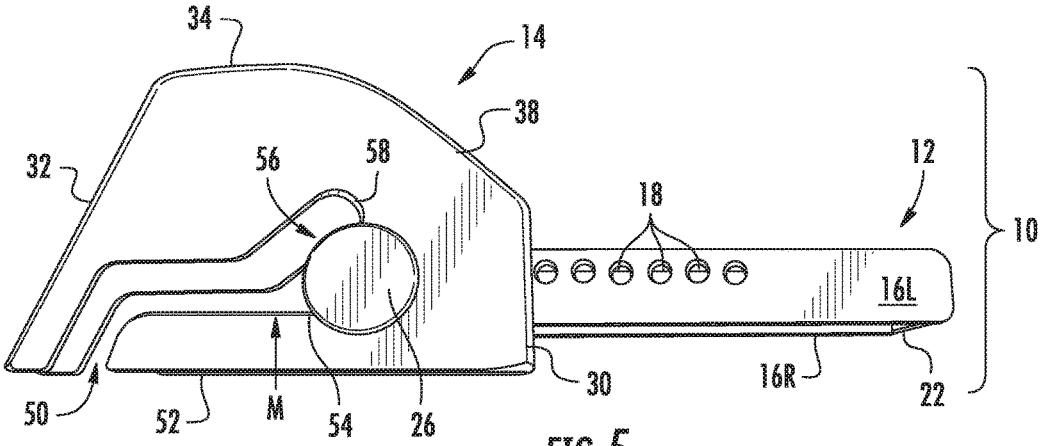
FIG. 5 shows a perspective view of the same left side from FIG. 4 but with its lower pin component advanced rearward and substantially parallel to the cover bottom, ready for locking in place.

Front wall 30 of outer cover 14 further includes a pair of cutout slits 40L and R that extend adjacent a lowermost edge 42 of front wall 30. These slits serve to keep the two main components, rail member 12 and outer cover 14, together when not in use. In another variation (FIG. 3A), slits 140L and R can be cut all the way down to a lowermost edge 142 of front wall 130 to outer cover 114 and then subsequently closed with a clip C or pullover bottom slide so as to first allow installation of a rail member into its outer cover before closing/locking it in place.

Each sidewall 36L and 36R of outer cover 14 has an intentional groove or "track" added for allowing the main metal pin 26 to first enter the cover proper from beneath (or below) before being slid into place along in said track while the metal pin is pulled snugly into place against the underside of the container box's main hauling hook. Particularly, each metal pin track 50 starts at the lowermost edge 52 of each sidewall 36L and R nearer the rear wall 32 portion of outer cover 14. That pin track 50 then runs for a brief stretch substantially parallel with said rear wall 32 before angling inwardly and running for a longer section of "channel" substantially parallel with lowermost edge 52 of the respective sidewalls 36L and R. In the first embodiment, with its angled rear wall, the first portion of track 50 is also correspondingly angled. In the second embodiment of FIGS. 6 through 10, however, that same portion of tracking runs at an almost right angle with its sidewalls' lowermost edges.

At a near midway point M of each sidewall 36L and R, track 50 branches off (at point "Y") into a first lower pathway 54 that still runs parallel to lowermost edge 52 as well as an upper branch-off pathway 56, at about a 30-60 degree, more preferably about a 45 degree angle, relative to said lowermost edge 54. The uppermost tip 58 of this second, branch-off pathway 56 preferably points to beveled section 38, between front wall 30 and top surface 34. When metal pin 26 gets inserted into track 50 and then pulled at point Y into the second, branch-off pathway 56, it would accommodate a greater variety of container box hook arrangements than most other currently made and sold lock box models in as much as the rail member 12 can, itself, be angled up (or down, in some instances) when pulled fully forward beneath the outer cover 14 before being locked in place with the positioning of one or more padlocks into one of the holes/apertures 18 closest to front wall 30 of this outer cover 14. To better accommodate such alternate track positioning via second branch-off pathway 56, slits 40L and 4R in front wall 30 may be purposefully extended (or stretched). In one instance (not shown), these same slits may even extend partially upwardly and inwardly into beveled section 38 of outer cover 14.

Version 2 (FIGS. 6 through 10) depicts a second preferred embodiment of the whole universal lock device 210, with its own rail member 212 and outer cover 214. In this alternative version, the pull handle 222 between main brackets 216L and R is not made integral with the latter two side rails but rather made as a smaller version of metal pin/juncture there between. The other main difference between first and second embodiments of this invention concern the use of a more flattened, right angled rear wall 132 in the embodiments of the latter FIGS. Such right angling may prove easier to mass produce and finish (with painting, detailing, etc.) than its beveled counterpart shown in FIGS. 2 through 5. Particularly, if the rear wall was suitable for branding (of one's own company name, product model name or number) or for the possible placement of third party promotional advertising thereon, a right angled rear face front could prove more appealing to the consuming public.

Figure 6:
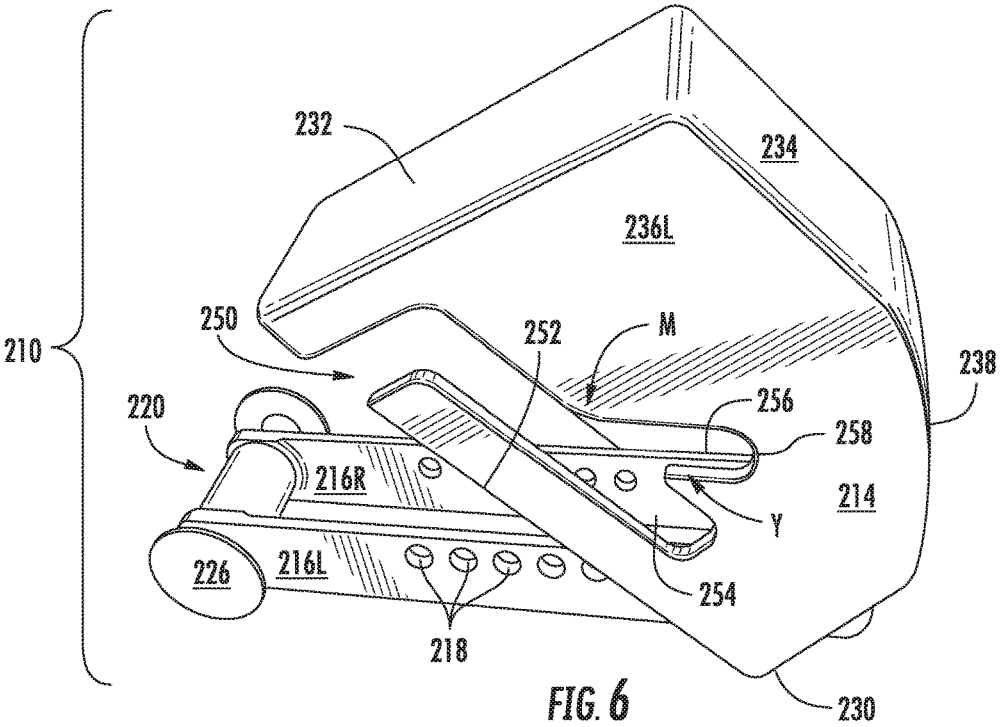
FIG. 6 shows a top perspective view of the invention's two main components before the cover/outer housing would be lowered onto the main hook pin slide.

FIGS. 6 though 10 also sequentially depict one method for installing the invention on a representative container box hook. First, per FIG. 6, the outer cover 214 is tilted forward, towards the forward end 220 of both lower main brackets 216L and R for better exposing metal pin 226 thereunder. That metal pin 226 would be fitted under a container box's hook and then the rail member 212 pulled forward (or in the direction of arrow F in FIG. 7) for metal pin 226 to slide along to a forward most point within lower pathway 254.

Figure 8:
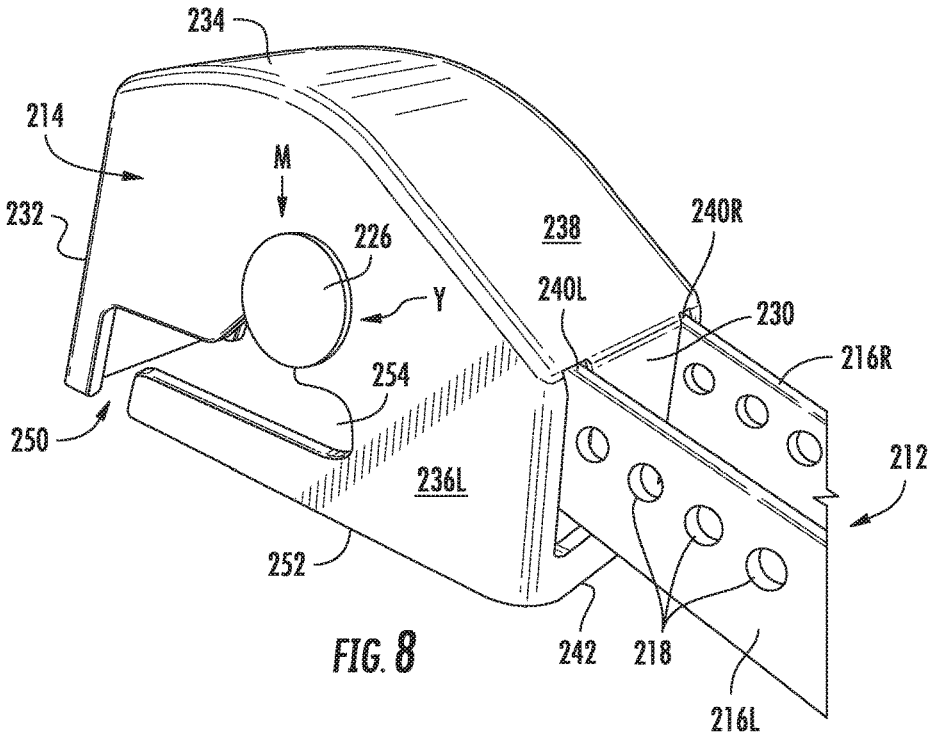
FIG. 8 shows a left forward perspective view of the FIG. 7 alternative embodiment with its slide pin having just entered the upper of the two pre-cut channels.

For an alternative configuration of container box hook design, FIG. 8 shows the same metal pin 226 being pulled to the uppermost portions of second pathway 256.

Figure 7:
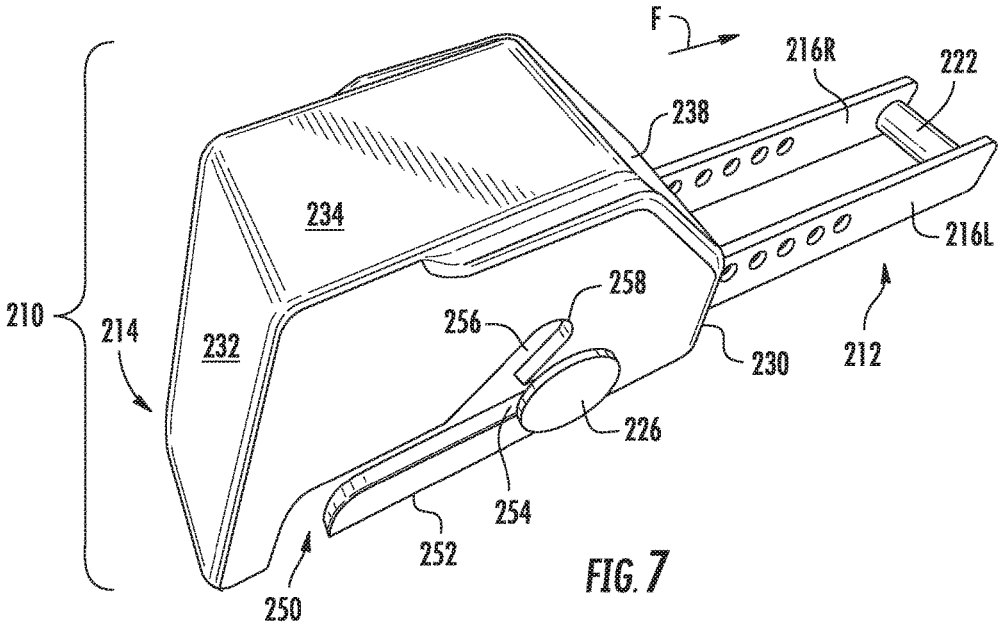
FIG. 7 shows a rear perspective view of a second embodiment having a flatter rear walled outermost cover with that cover lowered in place and its main hook pin slide pulled completely forward for locking.
Figure 9:
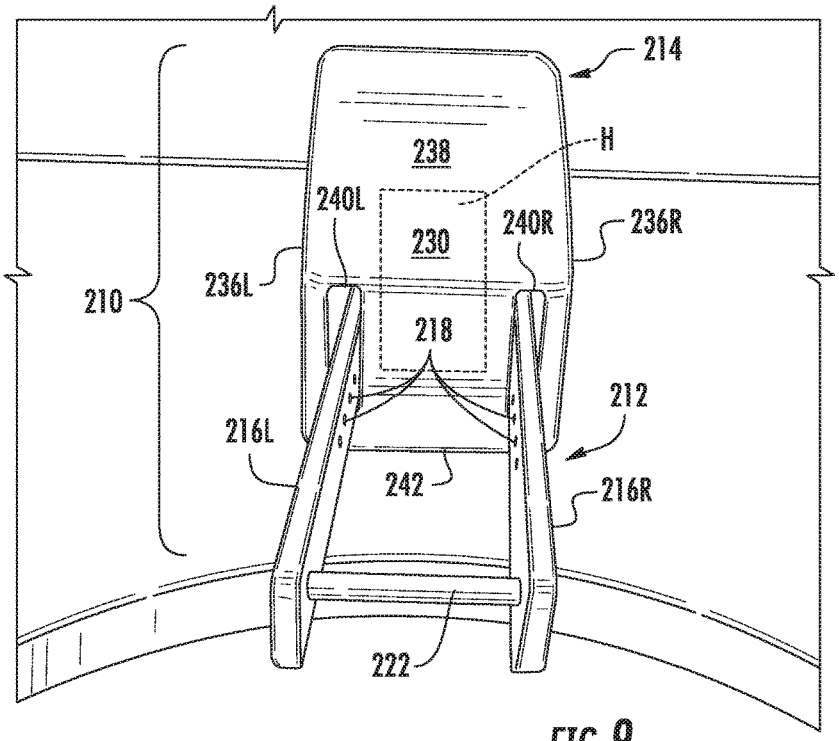
FIG. 9 shows a front axial view of the FIG. 8 embodiment installed over the hook of a representative container box (before padlocking into place), said hook region being indicated with a dash lines, letter H, in this view.
Figure 10:
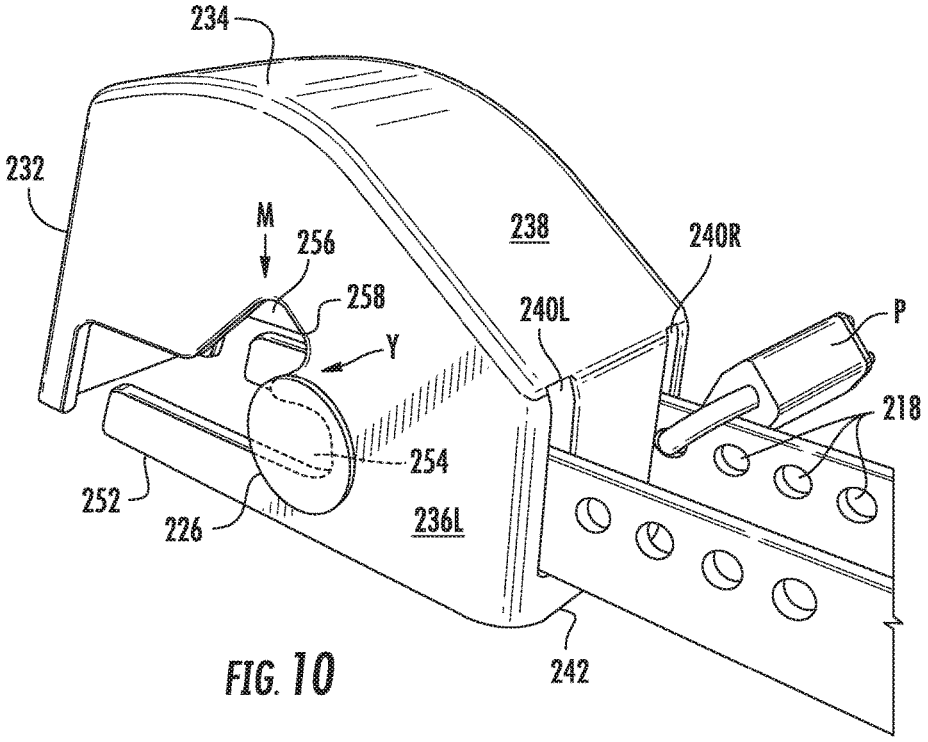
FIG. 10 shows a close up, top perspective view of one padlock installed in an aperture on the fully installed device of FIGS. 8 and 9.

FIG. 9 next shows the FIG. 7 variation once more, in an axial vie, installed over a container box hook that has been shown in silhouette via dashed lines, letter H. FIG. 9 also depicts a typical installation of device 210 BEFORE one or more padlocks are situated into the holes/apertures 218 in either main bracket 216L, main bracket 216R or both. FIG. 10 shows one such lock L in a hole/aperture 218 of right main bracket 216R closest to front wall 230 of that particular outer cover 214. It should be understood, however, that a single lock could just as easily lock device 210 in place when situated along left main bracket 216L or when using TWO locksets into both main brackets 216L and 216R.

Once pulled tight inside its outer cover/casing, at least one padlock P is fed into an open hole nearest the front wall of this cover/casing and then locked into place until no longer needed. It must be noted that, with this same design/improvement, it is quite a bit easier than the prior art, forward locking brackets of the Roc-Lock to undo and remove the padlock of this invention when desired. There will be no wrestling and/or repositioning of THESE brackets to free up the covered hook for subsequent authorized removal (via winching) of the box container back onto its truck bed/base.

The outer covers/casings are made from metal, preferably steel or aluminum. On a less preferred basis, they can be made from a resilient plastic or composite material.

Operation:

Slide the rear drawbars (rail member) forward towards the front of the Steal Stinger.

Place over equipment hook and pull drawbars (rail member) to the rear while pushing the Steal Stinger™ housing (outer cover) forward, thereby engaging the rear of the hook with the body and the underside of the hook with the drawbars (rail member). Pull taught and place lock on closest hole to Steal Stinger housing (outer cover). A cast iron shank lock provides the most security.

Technical Specs:

It uses 3/16 welded plate steel to provide maximum weight benefits while being strong enough to withstand abuse, metal cutting tools, and shear destructive forces from blunt force objects. It is tall & long enough to accommodate multiple size hooks 7.5"L×5.5"H ×2"W and smaller variations. It will be sold in a sandblasted & powder-coated state to ensure durable long life and smooth operation. Its dual drawbars (rail member) will include ¼" offset clasp holes that will allow for large/small locking mechanisms and cast iron shank locks are accommodated at various hook depths.

The foregoing drawings and discussion are illustrative of some specific embodiments of the present invention but are not meant to be limitations upon the practice thereof In view of the teaching presented herein, other modifications and variations of the present invention will be apparent to those of skill in the art.

What is claimed is:

1. A lock for a hook of a roll-off container box, said lock comprising:

(a) a rail member component consisting of two substantially parallel brackets, each bracket having a plurality of apertures there along for receiving at least one padlock after the lock is positioned on the hook of the container box, said rail member having a carrying handle at one end and a connector pin at or near an opposite end, said connector pin adapted for engaging with the hook of the container box; and (b) a box-like outer cover for the rail member, said outer cover having a front wall, a rear wall, a top surface and spaced apart sidewalls, said front wall having a vertical slit for each parallel bracket of the rail member to pass through, said sidewalls each having a track that commences at a bottom edge of the sidewall, extends parallel with the bottom edge for a portion of the sidewall before branching off into an upper pathway and a lower pathway, each track in the sidewalls being designed to allow the connector pin of the rail member to slide along when the lock is positioned on the hook of the container box and the rail member pulled towards the front wall of the outer cover.

2. The lock of claim 1 wherein said outer cover is configured so as to not present any surface that could enable an unauthorized tow hook to engage therewith.

3. The lock of claim 1 wherein said outer cover further includes a beveled wall between the front wall and the top surface.

4. The lock of claim 3 wherein the upper pathway of the track in each sidewall of the outer cover is directed towards the beveled wall between the front wall and the top surface.

5. The lock of claim 1 wherein the lower pathway of each track extends parallel with the bottom edge of each sidewall.

6. The lock of claim 1 wherein the upper pathway and the lower pathway of each sidewall track are synchronized to one another in size and shape.

7. The lock of claim 1 wherein the rear wall of the outer cover is angled upwardly towards the top surface of the outer cover and a first segment of each sidewall track extends substantially parallel with the angled rear wall.

8. The lock of claim 1 wherein the rear wall of the outer cover extends substantially perpendicular to the top surface of the outer cover and a first segment of each sidewall track extends substantially parallel with the substantially perpendicular rear wall.

9. The lock of claim 1 wherein the vertical slits in the front wall of the outer cover terminate at a point adjacent a lowermost edge of the front wall.

10. The lock of claim 1 wherein the vertical slits in the front wall of the outer cover extend to a lowermost edge of the front wall for closing off after the parallel brackets of the rail member are positioned under the outer cover.

11. The lock of claim 1 wherein the outer cover is fabricated from a metal selected from steel and aluminum.

12. The lock of claim 1 wherein the outer cover is fabricated from a material selected from a resilient plastic and a composite.

13. A universal lock for a hook of a roll-off container box, said lock comprising:

(a) a metal rail member component consisting of two substantially parallel brackets, each bracket having a plurality of apertures there along for receiving at least one padlock after the lock is positioned on the hook of the container box, said rail member having a carrying handle at one end and a connector pin at or near an opposite end, said connector pin adapted for engaging with the hook of the container box; and (b) a metal outer cover for the rail member, said outer cover having a front wall, a rear wall, a top surface, a beveled wall between the front wall and the top surface and spaced apart sidewalls, said front wall having a vertical slit for each parallel bracket of the rail member to pass through, said sidewalls each having a track that commences at a bottom edge of the sidewall, extends parallel with the bottom edge for a portion of the sidewall before branching off into an upper pathway that extends towards the beveled wall of the outer cover and a lower pathway that extends parallel with the bottom edge of the sidewall, each sidewall track being designed to allow the connector pin of the rail member to slide along when the lock is positioned on the hook of the container box and the rail member pulled towards the front wall of the outer cover.

14. The universal lock of claim 13 wherein the rear wall of the outer cover is angled upwardly towards the top surface of the outer cover and a first segment of each sidewall track extends substantially parallel with the angled rear wall.

15. The universal lock of claim 13 wherein the rear wall of the outer cover extends substantially perpendicular to the top surface of the outer cover and a first segment of each sidewall track extends substantially parallel with the substantially perpendicular rear wall.

16. The universal lock of claim 13 wherein the vertical slits in the front wall of the outer cover terminate adjacent a lowermost edge of the front wall.

17. A method for securing a roll-off container box comprising the steps of:

(a) providing a locking system that comprises: (i) a rail member component consisting of two substantially parallel brackets, each bracket having a plurality of apertures there along for receiving at least one padlock after the lock is positioned on the hook of the container box, said rail member having a carrying handle at one end and a connector pin at or near an opposite end, said connector pin adapted for engaging with the hook of the container box; and (ii) a box-like outer cover for the rail member, said outer cover having a front wall, a rear wall, a top surface, a beveled wall between the front wall and the top surface, and spaced apart sidewalls, said front wall having a vertical slit for each parallel bracket of the rail member to pass through, said sidewalls each having a track that commences at a bottom edge of the sidewall, extends parallel with the bottom edge for a portion of the sidewall before branching off into an upper pathway and a lower pathway, each track in the sidewalls being designed to allow the connector pin of the rail member to slide along when the lock is positioned on the hook of the container box and the rail member pulled towards the front wall of the outer cover;

(b) engaging the connector pin of the locking system with the hook of the container box;

(c) lowering the outer cover of the locking system over the hook of the container box;

(d) pulling the rail member of the locking system toward the front wall of the outer cover so that the connector pin slides in the sidewall tracks in the outer cover; and (e) passing an open padlock through at least one of the bracket apertures closest to the front wall of the outer cover.

18. The method of claim 17 wherein step (d) includes pulling the rail member of the locking system so that the connector pin slides in the upper pathway of the sidewall tracks towards the beveled wall of the outer cover.

19. The method of claim 17 wherein step (d) includes pulling the rail member of the locking system so that the connector pin slides in the lower pathway of the sidewall tracks towards the front wall of the outer cover.

* * * * *